United States Patent [19]

Smith et al.

[11] 4,295,424

[45] Oct. 20, 1981

[54] EXPLOSIVE CONTAINER FOR CAST PRIMER

[75] Inventors: Don H. Smith, Dallas, Tex.; Arthur F. Bowman, Tamaqua; Norman M. Junk, New Ringgold, both of Pa.

[73] Assignee: Atlas Powder Company, Dallas, Tex.

[21] Appl. No.: 32,777

[22] Filed: Apr. 24, 1979

[51] Int. Cl.[3] ..... C06C 11/00

[52] U.S. Cl. ..... 102/322; 102/275.4; 102/275.6; 102/320; 102/331; 102/275.5

[58] Field of Search ..... 102/24 R, 25, 26, 27 R

[56] References Cited

U.S. PATENT DOCUMENTS

| | | | |
|---|---|---|---|
| 3,431,851 | 3/1969 | Kern et al. | 102/24 R |
| 3,793,954 | 2/1974 | Johnston | 102/24 R X |
| 3,993,001 | 11/1976 | Hawes | 102/27 R X |
| 4,023,494 | 5/1977 | Barton et al. | 102/24 R |
| 4,060,033 | 11/1977 | Postupack et al. | 102/27 R X |
| 4,133,247 | 1/1979 | Calder et al. | 102/23 X |
| 4,178,852 | 12/1979 | Smith | 102/24 R |

FOREIGN PATENT DOCUMENTS 226600 10/1910 Fed. Rep. of Germany .... 102/24 R

*Primary Examiner*—Peter A. Nelson

*Attorney, Agent, or Firm*—Richards, Harris & Medlock

[57] ABSTRACT

A container for containing a thermosetting explosive charge and delay detonator element is provided. The lower portion of the container has an open bottom and contains the cast explosive charge. A projection and recess are located in that portion of the container which contains the cast explosive charge for retaining the explosive charge within the container and for preventing movement of the charge relative to the container once the charge has solidified. A tubular conduit is longitudinally disposed on the exterior of the container and dimensioned to receive a detonating cord. The container includes an integral alignment structure and housing for the insertion of a delay detonator unit having an initiating element and a delay detonator element adapted so that the initiating element can be positioned adjacent the tubular conduit with the delay detonator element positioned adjacent the cast explosive charge.

16 Claims, 6 Drawing Figures

EXPLOSIVE CONTAINER FOR CAST PRIMER

BACKGROUND OF THE INVENTION

This invention relates to explosive containers. In another aspect, this invention relates to an explosive container for containing cast explosive charges. In still another aspect, this invention relates to an explosive device for delay activated explosives which are to be detonated by a detonating cord. In a further aspect, this invention relates to an explosive device for delay activated explosives which protects against premature detonation of the explosives.

In blasting, it is common to use insensitive explosives or blasting agents such as ammonium nitrate-fuel oil compositions which are detonated by booster or primer charges containing high explosives that are sensitive enough to be detonated by ordinary blasting caps. In blasting operations, it is often advantageous to provide for delayed detonation to control rock fragmentation, rock throw and vibrations. While electric blasting caps have the advantage of precise timing, extraneous electricity from either man-made or natural sources presents a hazard of premature and unwanted detonation of such caps. Therefore, a highly reliable non-electric delay actuated explosive container capable of precise timing and initiating insensitive explosives and blasting agents would be very desirable and advantageous.

While it is necessary for the explosive container to be sturdy enough to resist breakage, from dropping or from the force generated by the detonating cord, for example, the explosive container cannot be cumbersome in design, manufacture and use because economical considerations will prevent its use and acceptance.

Therefore, a need exists for a sturdy and economical container for containing high explosives and a detonator delay unit for the delayed detonation of blasting agents such as ammonium nitrate-fuel oil compositions.

SUMMARY OF THE INVENTION

The present invention provides a relatively thin-walled polymeric container having an open bottom and top for containing a cast explosive charge in the bottom portion and having a structure in the top portion for receiving and aligning the initiating means of a detonator delay unit adjacent a tubular conduit which forms part of the container with the delay detonator means positioned adjacent the cast explosive charge. In the preferred embodiment, the explosive container is adapted for use with a detonator delay unit of the type having an initiating means and a delay detonator means and for containing a cast explosive charge. The explosive container includes a hollow body of generally circular cross-section open at both ends having a tubular conduit disposed longitudinally on the exterior of the body, the tubular conduit being dimensioned to receive a detonating cord. A partition is contained within and attached to the hollow body, extending over a cross-section of the hollow body and dividing the interior of the hollow body into a first volume for containing the cast explosive charge and a second volume. The partition includes an aperture connecting the first volume with the second volume, for allowing insertion of a detonator delay unit so that the delay detonator means is positionable adjacent the explosive charge and the initiating means is located in the second volume adjacent the tubular conduit. An alignment structure is provided in the second volume for aligning the initiating means adjacent the tubular conduit. A projection located in the first volume retains the cast explosive charge within the open-ended first volume. A recess may also be incorporated into the first volume side of the partition for preventing rotation of the cast explosive charge relative to the container.

BRIEF DESCRIPTION OF THE DRAWINGS

A more complete understanding of the invention may be had by reference to the following detailed description when taken in conjunction with the accompanying drawings wheren.

DETAILED DESCRIPTION OF THE INVENTION

Figure 1:
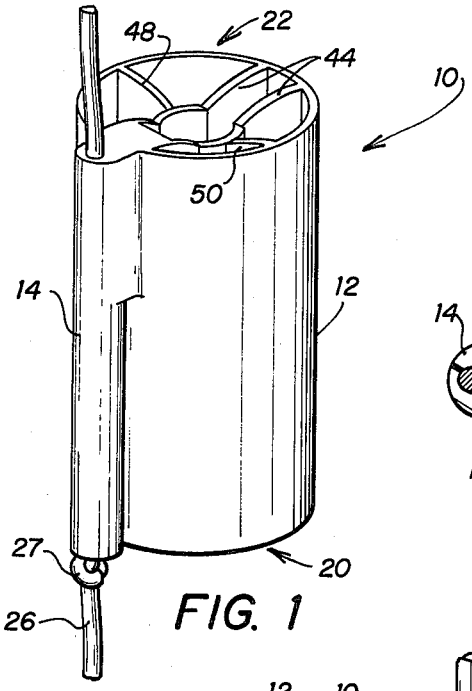
FIG. 1 is a perspective view showing the explosive container of the present invention.

Referring now to the drawings, and particularly to FIG. 1, there is shown an explosive container 10 of the present invention. Explosive container 10 comprises a hollow body 12, tubular conduit 14, partition 16 and alignment structure 18.

While hollow body 12 can be of any desired shape, hollow body 12 is preferably of generally circular cross-section and is open at bottom 20 and top 22. Explosive container 10 is preferably formed of a relatively non-demformable polymeric material in which explosive container 10 is formed in one piece. Any method known to those skilled in the art may be used to manufacture explosive container 10 such as, for example, blow molding or injection molding.

Figure 5:
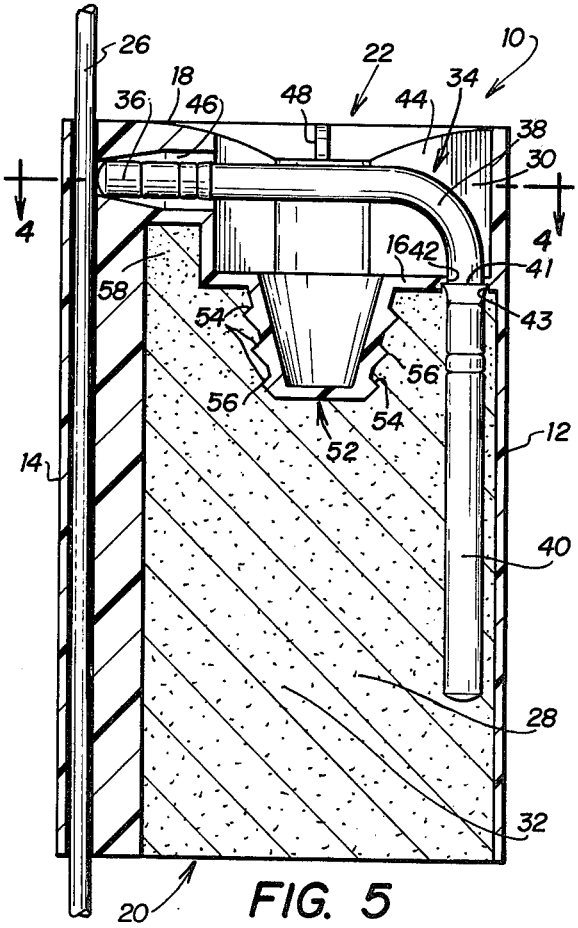
FIG. 5 is an elevational cross-sectional view of the armed explosive container of the present invention along lines 5—5 in FIG. 2.

Tubular conduit 14 is preferably disposed longitudinally on the exterior of hollow body 12 and is preferably coextensive with the length of hollow body 12. Tubular conduit 14 is dimensioned to receive a detonating cord 26 as shown in FIGS. 1 and 5.

One important application of the explosive device of the present invention is in the detonation of blasting agents or other primer sensitive explosives placed in boreholes. In such blasting operations it is often desirable to control the initiation of the explosives placed in the borehole such that a series of separate blasts occur rather than one large blast, for example. To accomplish this result, timed delay primers are used to initiate sequential portions of the blasting agents within the borehole by positioning the delay primers in spaced intervals and providing for delayed sequential detonation thereof. The explosive device of the present invention, when filled with high explosives and armed with a detonator delay unit, can be used in such applications. For example, explosive container 10 can be threaded with detonating cord 26 through tubular conduit 14. After detonating cord 26 passes through tubular conduit 14, a know 27 is tied adjacent the lower end thereof to prevent slippage, as shown in FIG. 1. Explosive container 10 is then lowered into a borehole and a blasting agent or a primer sensitive explosive is positioned in close proximity thereto. At a predetermined interval, a second charge explosive container may be threaded on detonating cord 26 and the cord again knotted and the explosive container lowered into the borehole. In this manner, a series of explosive containers 10 can be spaced throughout the depth of the borehole to be blasted and surrounded with a suitable blasting agent or other primer sensitive explosive composition. Upon ignition of detonating cord 26, the explosive containers 10 of the present invention in conjunction with the detonator delay units and explosive charges contained therein, will provide for a series of primer initiated explosions spaced fractions of a second apart at increasing or decreasing depths, as required for effective blasting in the particular application.

Partition 16 is contained within and attached to hollow body 12, as shown in FIGS. 2, 3, 4 and 5. Partition 16 extends over a cross-section of hollow body 12 and divides the interior of hollow body 12 into a first volume 28 and a second volume 30. First volume 28 is dimensioned to accommodate the desired quantity of cast high explosive charge 32 which will be hereinafter described in detail. Second volume 30 contains alignment structure 18 which preferably forms an integral part of explosive container 10.

Referring to FIGS. 2, 4, 5 and 6, a detonator delay unit 34 is secured to and aligned with explosive container 10. While any suitable detonator delay unit may be used, detonator delay unit 34 preferably includes initiating means 36, passive radiator 38, and delay detonator means 40. Initiating means 36 may be a small primer charge is acoustically coupled by means of passive radiator 38 to delay detonating means 40. Passive radiator 38 preferably comprises a flexible L-shaped hollow tubular element, or a flexible straight hollow tubular element which is bent into an L-shape when detonator delay unit 34 is inserted into container 10, manufactured from a suitable material such as polyethylene and is dimensioned to receive delay detonating means 40 and initiating means 36 at opposite ends thereof. Initiating means 36, which preferably contains a nominal 100 mg explosive charge, is positioned adjacent detonating cord 26. Alignment structure 18 insures that initiating means 36 is positioned in close proximity to detonating cord 26 so that initiating means 36 is detonated by the energy released from detonating cord 26 when detonating cord 26 is ignited. Delay detonating means 40 will generally comprise a delay blasting cap which detonates with sufficient energy to initiate cast high explosive charge 32. The L-shaped detonator delay unit 34 provides for the necessary separation between detonator cord 26 and delay detonating means 40 when detonator delay unit 34 is combined with the explosive device of the present invention as further described below.

Figure 3:
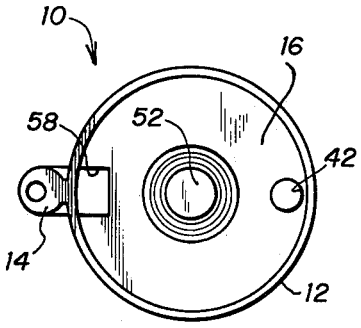
FIG. 3 is a bottom view of the explosive container of the present invention.

A partition aperture 42 extends through partition 16 so that initiating means 36 of detonator delay unit 34 can be aligned adjacent tubular conduit 14 in second volume 30 and delay detonating means 40 can be located in first volume 28 adjacent cast high explosive charge 32. Preferably, partition aperture 42 contains a lip 43 on the second volume 30 side of partition aperture 42 so that detonating means 40, preferably having a flared end 41, is restrained from removal once inserted through partition aperture 42. According to the invention, delay detonating means 40 can be in intimate contact with cast high explosive charge 32 located in first volume 28. Preferably, partition aperture 42 is positioned on the opposite side of hollow body 12 from tubular conduit 14 (as shown in FIG. 3) for minimizing the risk of premature detonation of delay detonating means 40 by detonating cord 26.

Figure 4:
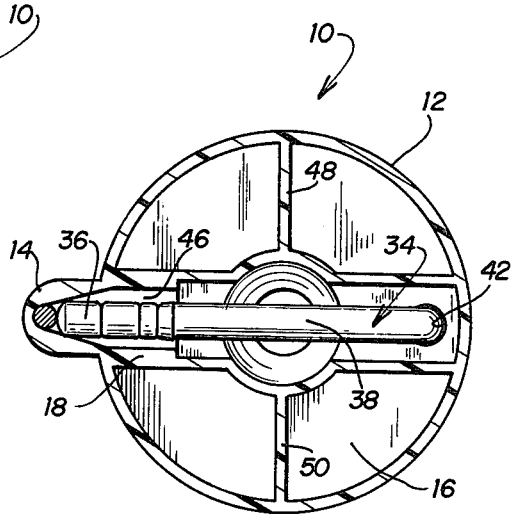
FIG. 4 is a cross-sectional view of the explosive container of the present invention along lines 4—4 in FIG. 5.

Alignment structure 18 includes alignment channel 44 which can extend from partition aperture 42 to tubular conduit 14 in second volume 30 of hollow body 12. Alignment channel 44 includes passageway 46 which is located adjacent tubular conduit 14. Passageway 46 is preferably normal to tubular conduit 14 and is dimensioned so that initiating means 36 may be inserted therein so that initiating means 36 is adjacent detonating cord 26 when detonator delay unit 34 is placed in position in explosive container 10 as shown in FIGS. 4 and 5. According to one embodiment of the invention, shown in FIG. 5, passageway 46 is dimensioned to allow initiating means 36 to be in contact with detonating cord 26. This embodiment is preferable when it is desired to space several explosive containers 10 at predetermined intervals in a borehole as previously described. Furthermore, the contact of initiating means 36 with detonating cord 26 allows the use of detonating cords down to about 7.5 gr./ft. core load.

Figure 6:
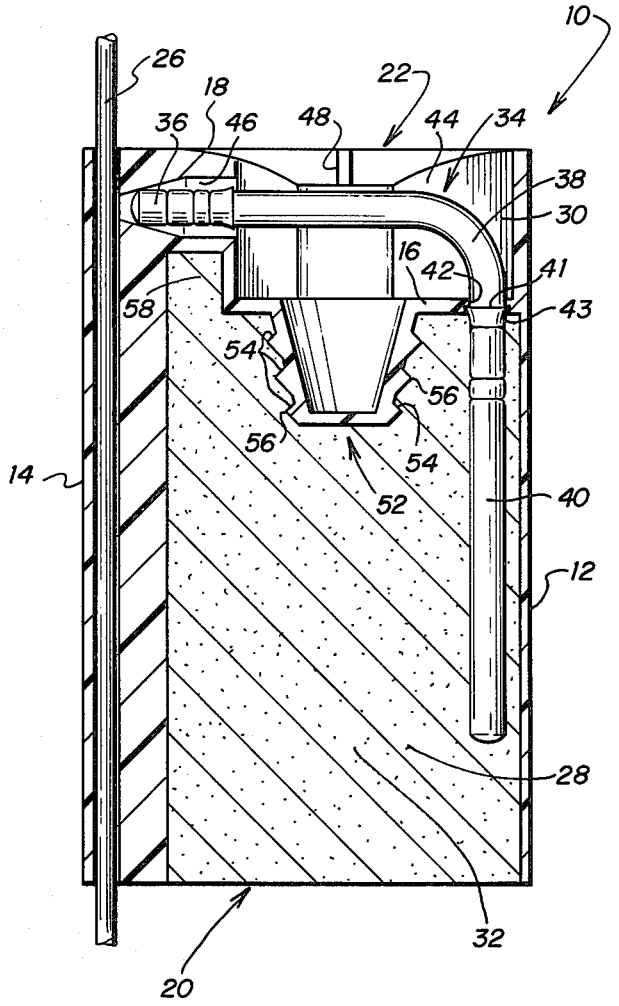
FIG. 6 is an elevational cross-sectional view of an alternate embodiment of the explosive container of the present invention.

In an alternate embodiment, shown in FIG. 6, passageway 46 is dimensioned to prevent initiating means 36 from contacting detonating cord 26. After one explosive container 10 is placed on the end of a knotted detonating cord and lowered into a borehole, additional explosive containers 10 can be loaded into the same borehole by threading the detonator cord through tubular conduit 14 and allowing each additional container 10 to slide down the detonating cord. This procedure can be repeated to load as many primers as desired in a given borehole using only one detonating cord downline.

Since a separation is required between detonating cord 26 and initiating means 36 to allow sliding, the explosive energy output of detonating cord 26 generally must be greater to initiate initiating means 36 than if initiating means 36 was in contact with detonating cord 26. Generally, detonating cords with core loads of from about 18 to about 30 gr./ft. perform reliably.

Figure 2:
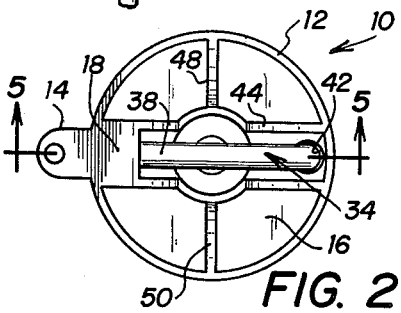
FIG. 2 is a top view of the explosive container according to the present invention.

Passageway 46 is preferably tapered as passageway 46 extends towards tubular conduit 14 so that initiating means 36 is in frictional engagement with passageway 46 adjacent tubular conduit 14 to prevent movement of initiating means 36 relative to detonating cord 26. Support ribs 48 and 50 shown in FIGS. 1, 2 and 4 provide strength and rigidity to explosive container 10.

Cast high explosive charge 32 is contained within first volume 28. Explosive charge 32 may be any high explosive known to those skilled in the art which is thermosetting. For example, explosive charge 32 may comprise TNT (trinitrotoluene), RDX (cyclonite), PETN (pentaerythritol tetranitrate), HMX (cyclotetramethylenetetranitramine) or mixtures thereof. One advantage of the invention is that explosive container 10 may be economically produced and easily armed with explosive charge 32 and delay detonating means 40 as shown in FIG. 5, for example. In arming explosive container 10 of the present invention, the desired amount of explosive charge 32 may be introduced while in a fluid state into first volume 28. While in the fluid state, explosive charge 32 will conform to the shape of first volume 28. Upon solidifying into a unitary mass, explosive charge 32 will be retained and prevented from movement relative to explosive container 10 as hereinafter described.

Explosive container 10, according to the invention, is constructed so that explosive charge 32 is contained in first volume 28 of hollow body 12 without the requirement or necessity for a closed container. Despite bottom 20 being open, explosive charge 32 will not become dislodged from hollow body 12 under normal use of explosive container 10. Projection 52 located within first volume 28 acts to retain explosive charge 32 within explosive container 10. While projection 52 can be of any desired shaped as long as it retains explosive charge 32 within hollow body 12, preferably projection 52 will be in the shape of an inverted truncated cone having a plurality of circumferential serrations 54 as shown in FIG. 5. In the most preferred embodiment, the sides of projection 52 form an angle of about 15° from the vertical and the largest diameter of projection 52 is approximately equal to the height of projection 52. Preferably, the angle formed by the projecting edge 56 of circumferential serrations 54 is about 90°. According to the preferred embodiment of the invention, projection 52 forms an integral part of partition 16.

To further prevent dislodging of explosive charge 32 from hollow body 12 and to prevent movement of explosive charge 32 relative to hollow body 12, a recess 58 may be incorporated in partition 16 as shown in FIGS. 3 and 5. Recess 58 may be rectangular, as shown in FIGS. 3 and 5, although no specific shape is required. The size of recess 58 should be large enough to allow explosive charge 32, when in a fluid state, to fill recess 58, thereby forming a shape complimentary to the shape of recess 58.

In constructing an explosive container according to the invention, hollow body 12 of explosive container 10 is preferably injection molded low density polyethylene. For an explosive container having a cross-setional diameter of approximately 2.5 inches (not including tubular conduit 14) and a height of approximately 5 inches, the cylindrical walls of hollow body 12 are preferably from about 0.065 to about 0.075 inches. The combined thickness of the wall of hollow body 12 and tubular conduit 14 between explosive charge 32 and aperture 24 in tubular conduit 14 is preferably from about 0.20 to about 0.45 inches. This separates detonating cord 26 from explosive charge 32 to minimize any risk of unwanted or premature detonation of explosive charge 32.

Although preferred embodiments of the invention have been illustrated in the accompanying drawings and described in the foregoing detailed description, it will be understood that the invention is not limited to the embodiments disclosed, but is capable of numerous rearrangements, modifications, and substitutions of parts and elements without departing from the spirit of the invention.

What is claimed is:

1. An explosive container for use with a detonator delay unit of the type having an initiating means and a delay detonator means and for containing a cast explosive charge comprising:

a hollow body having closed sides and two open ends with a tubular conduit disposed longitudinally on the exterior of said body, said tubular conduit being dimensioned to receive a detonating cord;

partition means contained within and attached to said hollow body, said partition means extending over a cross-section of said hollow body and dividing the interior of said hollow body into an open-ended first volume and an open-ended second volume, said first volume for containing the cast explosive charge, said partition means having an aperture therein to allow the detonator delay unit to be positioned wherein the delay detonator means is positionable adjacent the explosive charge and the initiating means is located in said second volume;

means located in said second volume for aligning the initiating means adjacent said tubular conduit;

means for retaining the cast explosive charge within said open-ended first volume.

2. The container as recited in claim 1 wherein said means for retaining the cast explosive charge includes a projection which extends from said partition means into said first volume.

3. The container as recited in claims 1 or 2 wherein said aperture in said partition means is opposite said tubular conduit.

4. An explosive container for use with a detonator delay unit of the type having an initiating means and a delay detonator means and for containing a cast explosive charge comprising:

a hollow body of generally circular cross-section open at both ends, having a tubular conduit disposed longitudinally on the exterior of said body, said tubular conduit being dimensioned to receive a detonating cord;

partition means contained within and attached to said hollow body, said partition means extending over a cross-section of said hollow body and dividing the interior of said hollow body into an open-ended first volume and an open-ended second volume, said first volume for containing the cast explosive charge, said partition means having an aperture therein to allow said detonator delay unit to be positioned wherein the delay detonator means is positionable in the first volume adjacent the explosive charge and the initiating means is located in said second volume;

alignment means located in said first volume for aligning the initiating means adjacent said tubular conduit;

means for retaining the cast explosive charge within said open-ended first volume.

5. The container as recited in claim 4 wherein said alignment means forms an integral part of the container and includes a passageway dimensioned to receive said initiating means which passageway communicates with said tubular conduit so that said initiating means is adjacent said tubular conduit when inserted into said passageway.

6. The container as recited in claim 4 wherein said means for retaining the cast explosive includes a projection which extends from said partition means into said first volume.

7. The container as recited in claim 6 wherein said projection is in the shape of an inverted truncated cone and said projection contains at least one circumferential serration.

8. The container as recited in claim 4 wherein said means for retaining the cast explosive charge includes means for preventing rotational movement of said cast explosive charge relative to said hollow body.

9. The container as recited in claim 8 wherein said means for preventing rotation includes a recess in said partition means.

10. The container as recited in claim 7 wherein the curved sides of said truncated cone form an angle of about 15° from the vertical.

11. The container as recited in claims 4, 5, 6 or 7 wherein said apperture in said partition means is opposite said tubular conduit.

12. The container as recited in claim 4 wherein said tubular conduit has a thickened wall which separates the cast explosive charge from the detonating cord contained within said tubular conduit.

13. The container as recited in claim 4 further comprising a thermosetting explosive charge contained within said open-ended first volume.

14. The container as recited in claim 13 wherein said thermosetting explosive is selected from the group consisting of RDX, TNT, PETN, HMX and mixtures thereof.

15. The container as recited in claims 4, 5, 6, or 7 wherein said aperture includes a lip located on the second volume side of said aperture for restraining said detonator delay means from being removed from said first volume after insertion therein.

16. The container as recited in claims 4, 5, 6 or 7 wherein said passageway is dimensioned to restrict said initiating means from contacting a detonating cord contained within said tubular conduit.

* * * * *

UNITED STATES PATENT AND TRADEMARK OFFICE

CERTIFICATE OF CORRECTION

PATENT NO. : 4,295,424

DATED : October 20, 1981

INVENTOR(S) : Don H. Smith, et al.

It is certified that error appears in the above-identified patent and that said Letters Patent are hereby corrected as shown below:

Column 2, line 12, change "wheren" to --wherein--;
line 68, change "know" to --knot--.

Column 3, line 35, change "charge is" to --charge which is--.

Column 4, line 65, change "may" to --can--.

Column 6, line 55, change "explosive includes" to --explosive charge includes--.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*